US008044860B2

(12) United States Patent
Tang et al.

(10) Patent No.: US 8,044,860 B2
(45) Date of Patent: Oct. 25, 2011

(54) INTERNAL ANTENNA FOR MOBILE DEVICE

(75) Inventors: Chia-Lun Tang, Miaoli (TW); Kin-Lu Wong, Kaohsiung (TW); Saou-wen Su, Taipei (TW)

(73) Assignees: Industrial Technology Research Institute, Chutung, Hsinchu (TW); National Sun Yatsen University, Chutung, Hsinchu (TW)

( * ) Notice: Subject to any disclaimer, the term of this patent is extended or adjusted under 35 U.S.C. 154(b) by 119 days.

(21) Appl. No.: 11/279,588

(22) Filed: Apr. 13, 2006

(65) Prior Publication Data

US 2007/0115179 A1 May 24, 2007

Related U.S. Application Data

(60) Provisional application No. 60/739,628, filed on Nov. 23, 2005.

(51) Int. Cl.
*H01Q 1/38* (2006.01)

(52) U.S. Cl. ..... 343/700 MS; 343/702; 343/798; 343/806; 343/895

(58) Field of Classification Search ..... 343/700 MS, 343/702, 806, 895, 846, 848
See application file for complete search history.

(56) References Cited

U.S. PATENT DOCUMENTS

| | | | | |
|---|---|---|---|---|
| 5,365,246 | A * | 11/1994 | Rasinger et al. | 343/702 |
| 5,936,583 | A * | 8/1999 | Sekine et al. | 343/702 |
| 6,046,700 | A * | 4/2000 | Kitchener et al. | 343/725 |
| 6,246,371 | B1 * | 6/2001 | Kurz et al. | 343/702 |
| 6,433,746 | B2 * | 8/2002 | Kushihi et al. | 343/700 MS |
| 6,812,892 | B2 * | 11/2004 | Tai et al. | 343/700 |
| 6,891,504 | B2 * | 5/2005 | Cheng et al. | 343/700 MS |
| 6,911,944 | B2 * | 6/2005 | Sekine et al. | 343/702 |
| 6,972,722 | B2 * | 12/2005 | Katoh et al. | 343/702 |
| 7,084,813 | B2 * | 8/2006 | Pathak et al. | 343/700 MS |
| 7,119,746 | B2 * | 10/2006 | Luk et al. | 343/702 |
| 7,119,747 | B2 * | 10/2006 | Lin et al. | 343/702 |
| 7,289,071 | B2 * | 10/2007 | Hung et al. | 343/702 |
| 2004/0207557 | A1 * | 10/2004 | Chen et al. | 343/702 |

FOREIGN PATENT DOCUMENTS

| | | | |
|---|---|---|---|
| JP | 11-274843 | A | 10/1999 |
| KR | 10-2004-0000535 | | 1/2004 |

* cited by examiner

*Primary Examiner* — Douglas W Owens
*Assistant Examiner* — Chuc Tran
(74) *Attorney, Agent, or Firm* — Alston & Bird LLP

(57) ABSTRACT

A mobile device includes a ground plane, a conductive housing disposed on the ground plane including a sidewall, a first conductive strip spaced apart from the conductive housing, and a second conductive strip electrically connecting the first conductive strip to the conductive housing.

13 Claims, 10 Drawing Sheets

INTERNAL ANTENNA FOR MOBILE DEVICE

CROSS-REFERENCE TO RELATED APPLICATIONS

This application claims the benefit of U.S. Provisional Application No. 60/739,628, filed Nov. 23, 2005, which is herein incorporated by reference in its entirety.

BACKGROUND OF THE INVENTION

The present invention generally relates to a communication device and, more particularly, to a mobile communication device having an internal monopole antenna integrated with a conductive surface.

One of the components that seem to have been given less consideration at the mobile level by phone manufacturers is the antenna. In fact, little change has been done at the antenna. With the progress in semiconductor manufacturing processes and telecommunications techniques, however, interest in a compact, light-weight and low-profile antenna for mobile devices is growing A variety of low-profile monopole antennas that are designed to be embedded inside the casings of mobile devices, such as mobile phones and personal digital assistants ("PDAs"), as internal antennas have been demonstrated recently. However, during conventional antenna design processes, an internal monopole antenna is usually tested in a stand-alone condition without taking into consideration other components such as the shielding metal case of an RF ("radio frequency") module, RF circuitry and the battery, which are disposed near the internal monopole antenna. Failure to integrate the antenna and shielding metal case may generally result in an uneconomical use of the space within a mobile communication device, and may in turn contradict the goal of being compact and low profile.

FIG. 1 is a schematic diagram of a conventional mobile device 10. Referring to FIG. 1, the mobile device 10 includes a ground plane 11, a shielding metal case 12, an antenna 13, a shorting pin 14 and a feeding pin 15. The antenna 13, in the form of a printed inverted-F antenna ("PIFA"), is separated from the shielding metal case 12 by an isolation distance d, which is required to avoid coupling effects between the antenna 13 and the shielding metal case 12 or associated nearby components. Such an isolation distance d may generally be about 7 mm (millimeter) or greater so that the performance of the antenna 13 is not degraded by the coupling effects. The requirement for such an isolation distance d limits the effective usage of the internal spacing in a mobile device.

It is therefore desirable to have a mobile device that has a relatively small distance between an internal monopole antenna and a shielding metal case or other nearby components of the mobile device without compromising the performance of the monopole antenna.

BRIEF SUMMARY OF THE INVENTION

The present invention is directed to an internal monopole antenna that obviates one or more problems resulting from the limitations and disadvantages of the prior art.

In accordance with an embodiment of the present invention, there is provided a mobile device that comprises a ground plane, a conductive housing disposed on the ground plane including a sidewall, a first conductive strip spaced apart from the conductive housing, and a second conductive strip electrically connecting the first conductive strip to the conductive housing.

Still in accordance with an embodiment of the present invention, there is provided a mobile device that comprises a ground plane, a conductive housing disposed on the ground plane including a conductive surface, and an antenna comprising a first conductive strip spaced apart from the conductive surface, and a second conductive strip electrically connecting the first conductive strip to the conductive surface of the conductive housing.

Further in accordance with an embodiment of the present invention, there is provided a mobile device that comprises a ground plane including a side, a conductive housing disposed on the ground plane including a sidewall flush with the side of the ground plane, a first conductive strip extending generally parallel with and spaced apart from the sidewall of the conductive housing, and a second conductive strip electrically connecting the first conductive strip to the conductive housing.

BRIEF DESCRIPTION OF THE SEVERAL VIEWS OF THE DRAWINGS

The foregoing summary as well as the following detailed description of the preferred embodiments of the present invention will be better understood when read in conjunction with the appended drawings. For the purposes of illustrating the invention, there are shown in the drawings embodiments which are presently preferred. It is understood, however, that the invention is not limited to the precise arrangements and instrumentalities shown. In the drawings.

DETAILED DESCRIPTION OF THE INVENTION

Figure 1:
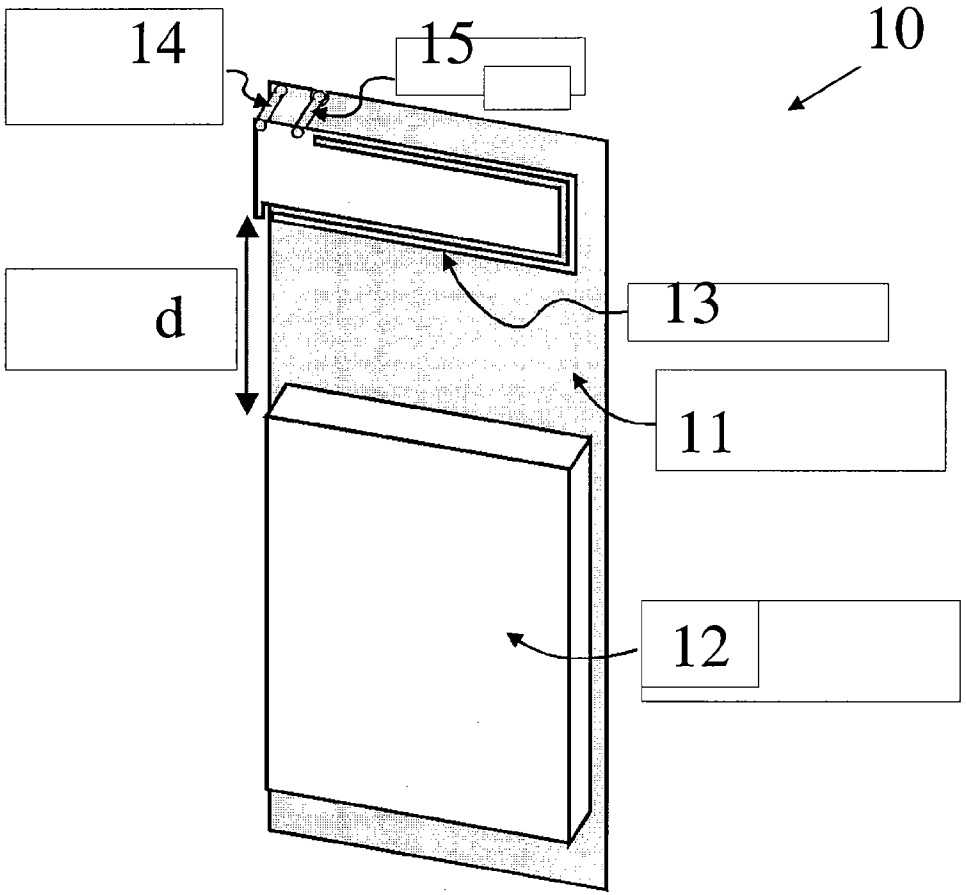
Fig. 1 (PRIOR ART)
FIG. 1 is a schematic diagram of portions of a conventional mobile device.
Figure 2A:
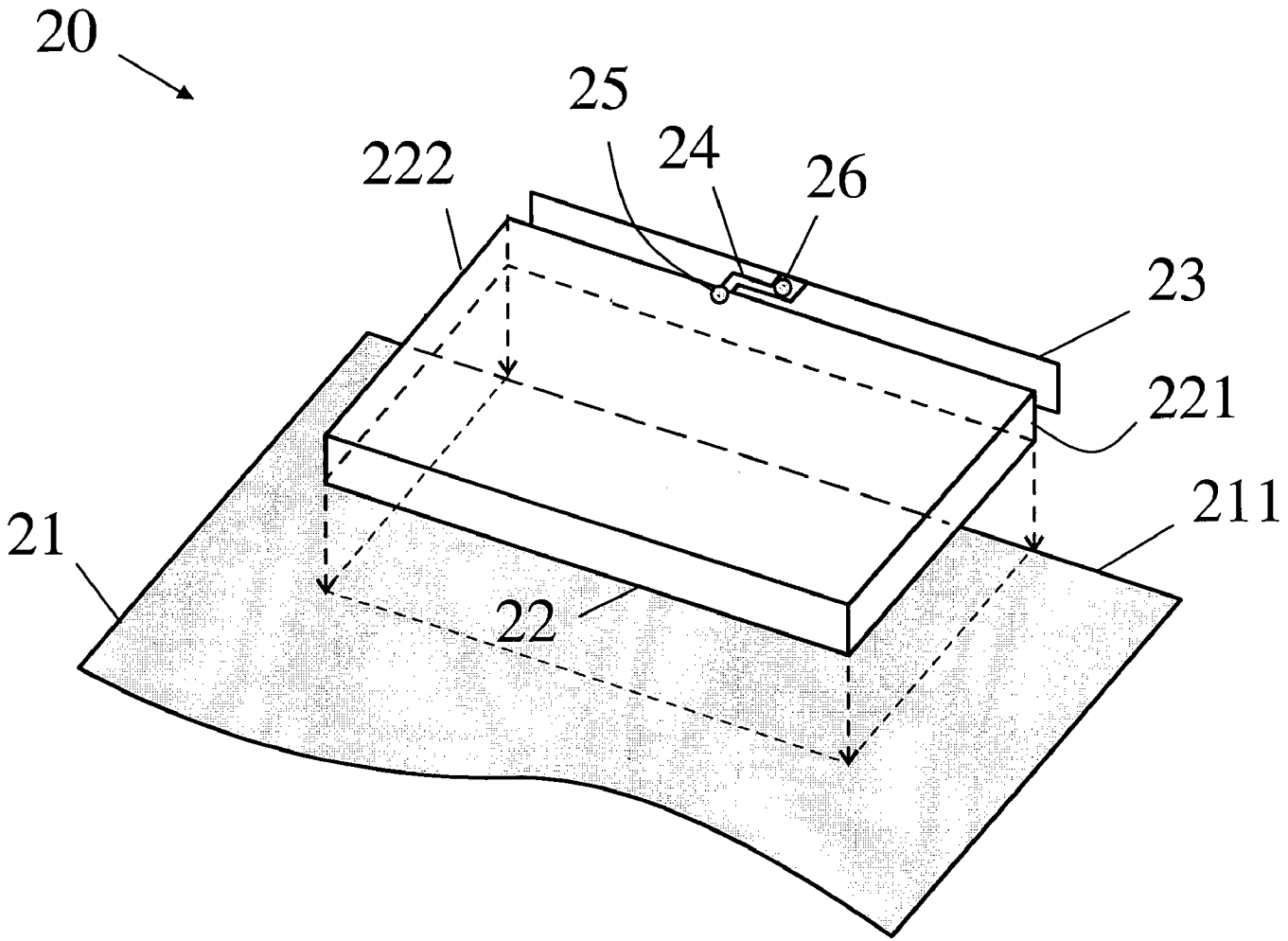
FIG. 2A is a schematic diagram of portions of a mobile device in accordance with one embodiment of the present invention.

FIG. 2A is a schematic diagram of portions of the interior of a mobile device 20 in accordance with one embodiment of the present invention. Referring to FIG. 2A, mobile device 20 includes a ground plane 21, an electrically conductive housing 22, a first conductive strip 23 and a second conductive strip 24. The conductive housing 22, for example, a metal case, accommodates radio frequency ("RF") modules such as transmitters or receivers therein and protects the RF modules, RF circuitry or battery from interference caused by other radiation sources, i.e., the coupling effects. The conductive housing 22 need not necessarily entirely seal the modules, circuitry or battery. The conductive housing 22 is electrically connected to the ground plane 21, which may be a circuit board surface. A sidewall 221 of the conductive housing 22 is substantially flush with a side 211 of the ground plane 21. A shorting contact 25 is disposed on a conductive surface, for example, the sidewall 221 or a top surface 222 of the conductive housing 22. The first conductive strip 23, extending generally parallel with the sidewall 221 of conductive housing 22, functions to serve as a radiating element for the mobile device 20. The second conductive strip 24, disposed between the conductive housing 22 and the first conductive strip 23, includes one end (not numbered) electrically connected to the shorting contact 25 and the other end (not numbered) electrically connected to the first conductive strip 23, proximate to or near a feeding contact 26.

Figure 2B:
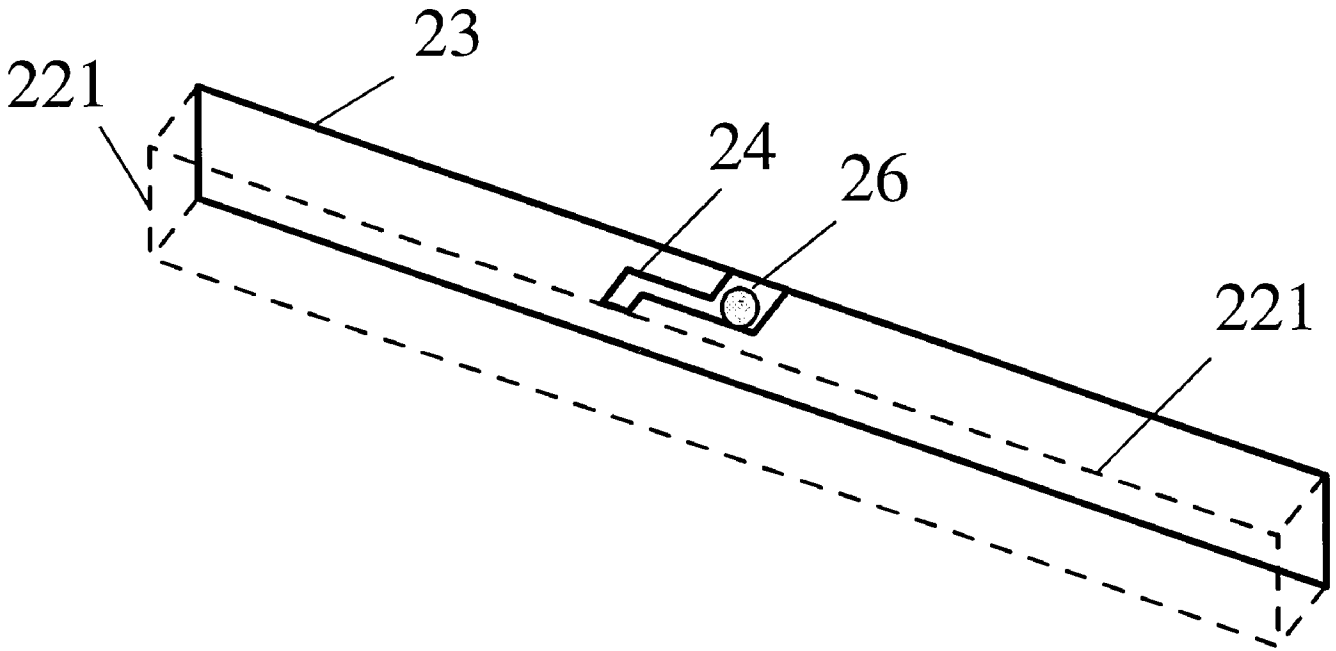
FIG. 2B is an enlarged perspective view of a first conductive strip and a second conductive strip shown in FIG. 2A.

FIG. 2B is an enlarged perspective view of the first conductive strip 23 shown in FIG. 2A. Referring to FIG. 2B, the second conductive strip 24, is integrated with the first conductive strip 23 and a conductive surface such as the sidewall 221 or the top surface 222 of the conductive housing 22, and includes a winding path extending between the first conductive strip 23 and the conductive surface. The feeding contact 26 is disposed proximate to the other end of the second conductive strip 24. The first conductive strip 23, second conductive strip 24, shorting contact 25 and feeding contact 26 collectively form a monopole antenna for the mobile device 20. In one embodiment according to the present invention, the conductive housing 22, first conductive strip 23 and second conductive strip 24 are formed out of a single metal sheet by conventional cutting and/or stamping processes or other suitable processes known to skilled persons in the art. However, the first and second conductive strips 23, 24 may be separately formed if desired and may be electrically connected in any known manner. Further, the first and second conductive strips 23, 24 may be made of some other conductive material and could take a shape other than the generally rectangular shape shown in the drawings.

Figure 3:
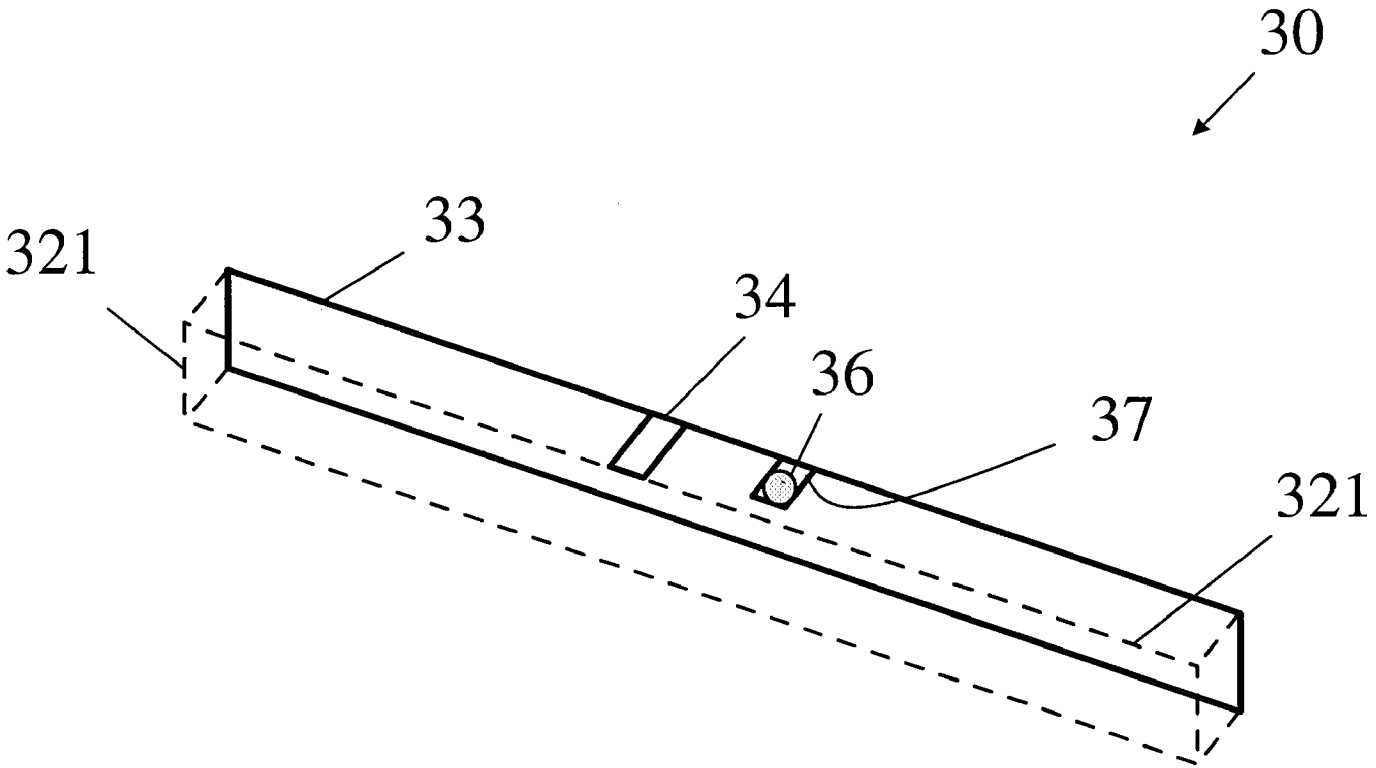
FIG. 3 is a diagram illustrating a monopole antenna of a mobile device in accordance with another embodiment of the present invention.

FIG. 3 is a diagram illustrating a monopole antenna 30 of a mobile device in accordance with another embodiment of the present invention. Referring to FIG. 3, the monopole antenna 30 includes a first conductive strip 33, a second conductive strip 34 and a third conductive strip 37. The first conductive strip 33 extends generally parallel with a sidewall 321 (shown in phantom) of a conductive housing (not shown). The second conductive strip 34 is integrated with the first conductive strip 33 and a conductive surface such as the sidewall 321. The third conductive strip 37, protruding from the first conductive strip 33, is separated from the second conductive strip 34 and from the sidewall 321 of the conductive housing. A feeding contact 36 is formed on the third conductive strip 37. The second and third conductive strips 34 and 37 are substantially disposed in a center region between the first conductive strip 33 and the sidewall 321.

Figure 4A:
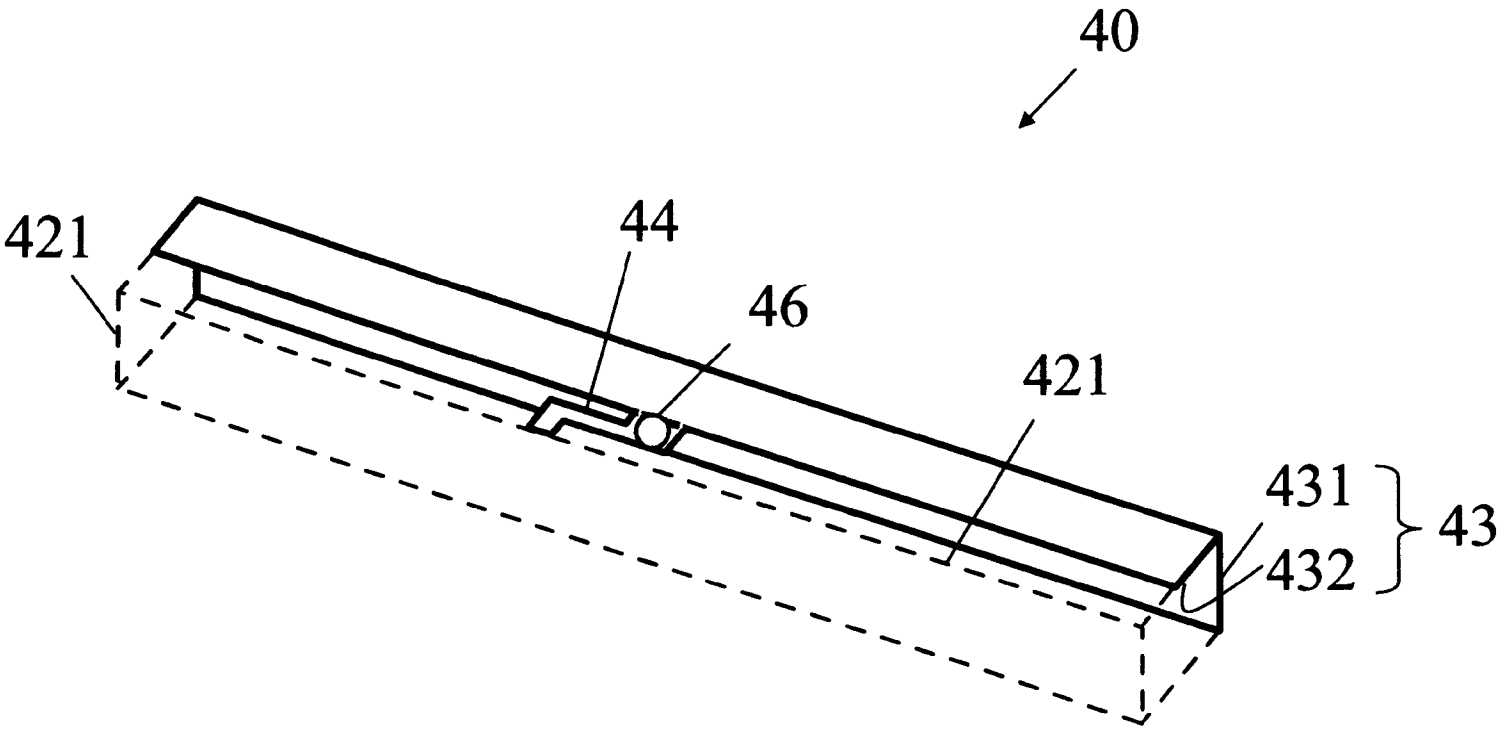
FIG. 4A is a diagram illustrating a monopole antenna of a mobile device in accordance with still another embodiment of the present invention.

FIG. 4A is a diagram illustrating a monopole antenna 40 of a mobile device in accordance with still another embodiment of the present invention. Referring to FIG. 4A, the monopole antenna 40 includes a first conductive strip 43 and a second conductive strip 44. The first conductive strip 43 further includes a first portion 431 extending generally parallel with a sidewall 421 of a conductive housing (not shown), and a second portion 432 protruding from the first portion 431 and spaced apart from the sidewall 421. In one embodiment according to the present invention, the second portion 432 is substantially orthogonal to the first portion 431, resulting in an L-shaped first conductive strip 43. The second conductive strip 44 includes a winding path extending from the second portion 432 to the sidewall 421. A feeding contact 46 is disposed on the second conductive strip 44.

Figure 4B:
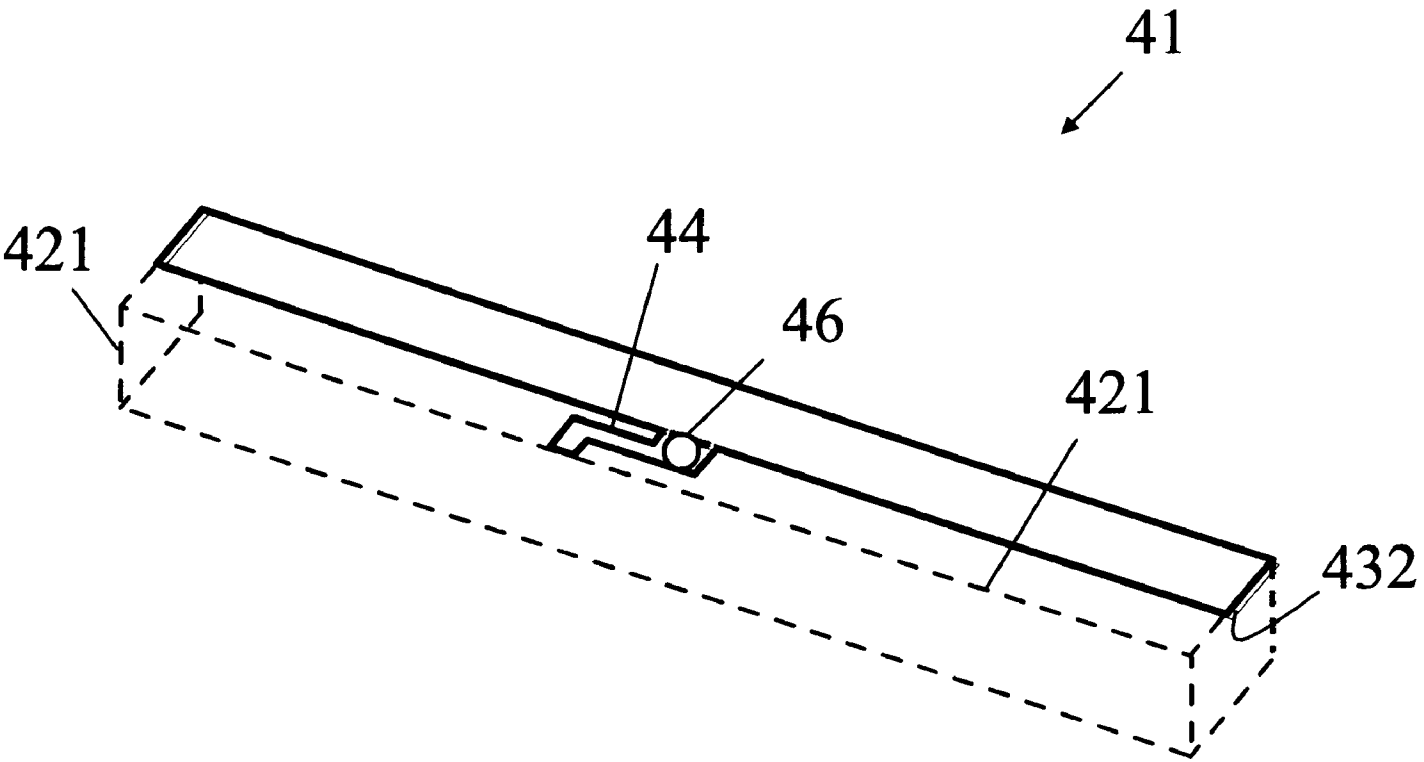
FIG. 4B is a diagram illustrating a monopole antenna of a mobile device in accordance with yet still another embodiment of the present invention.

FIG. 4B is a diagram illustrating a monopole antenna 41 of a mobile device in accordance with yet still another embodiment of the present invention. Referring to FIG. 4B, the monopole antenna 41 has a similar structure to the monopole antenna 40 shown in FIG. 4A except that the first portion 431 is eliminated.

Figure 5:
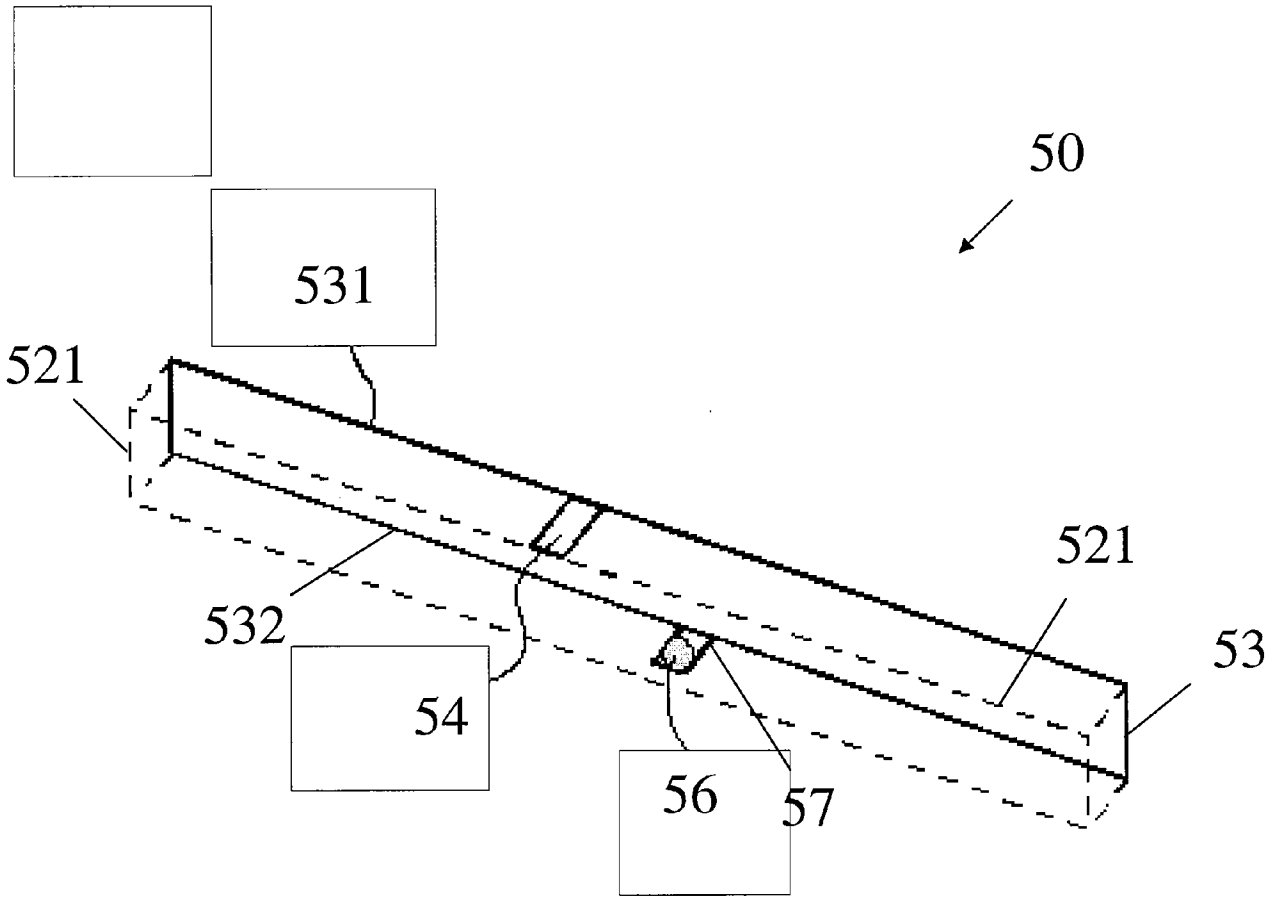
FIG. 5 is a diagram illustrating a monopole antenna of a mobile device in accordance with yet another embodiment of the present invention.

FIG. 5 is a diagram illustrating a monopole antenna 50 of a mobile device in accordance with yet another embodiment of the present invention. Referring to FIG. 5, the monopole antenna 50 includes a first conductive strip 53, a second conductive strip 54 and a third conductive strip 57. The first conductive strip 53 extends generally parallel with a sidewall 521 of a conductive housing (not shown). The second conductive strip 54, protruding from a first or upper edge 531 of the first conductive strip 53, is integrated with the first conductive strip 53 and the sidewall 521. The third conductive strip 57, protruding from a second or lower edge 532 of the first conductive strip 53, is spaced apart from the sidewall 521. A feeding contact 56 is formed on the third conductive strip 57.

Figure 6:
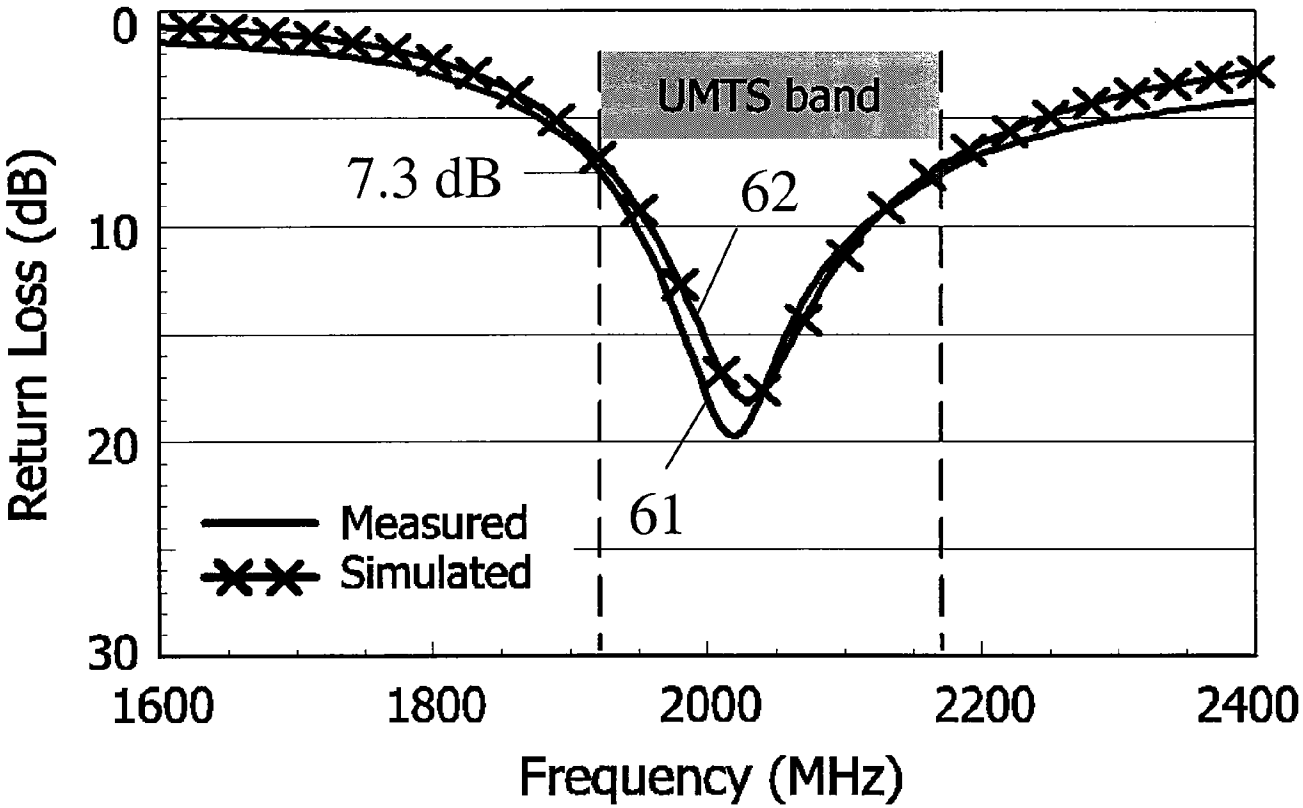
FIG. 6 is a plot illustrating experimental results of a monopole antenna in accordance with one embodiment of the present invention.
Figure 7A:
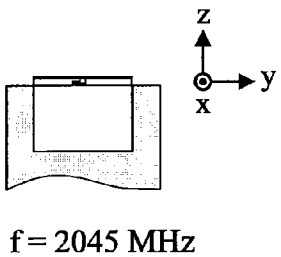
FIGS. 7A to 7D are diagrams illustrating radiation patterns of a monopole antenna in accordance with one embodiment of the present invention.
Figure 7B:
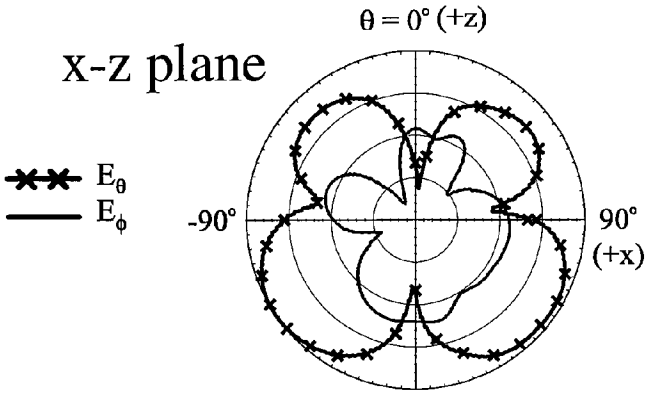
Figure 7C:
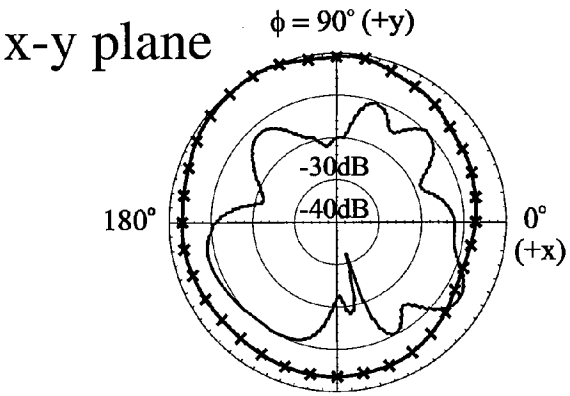
Figure 7D:
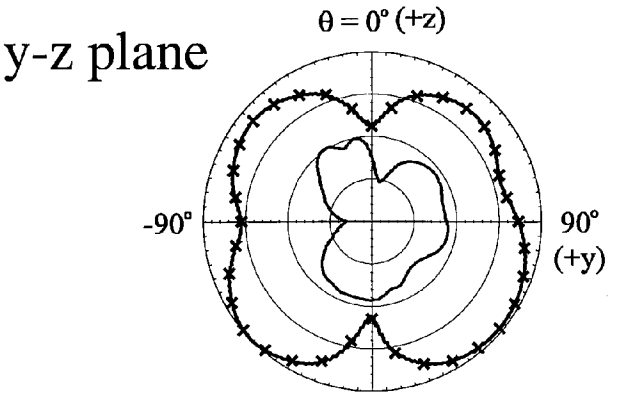

FIG. 6 is a plot illustrating experimental results of a monopole antenna in accordance with one embodiment of the present invention. The experiment was conducted on, for example, the mobile device 20 illustrated in FIG. 2A. The dimensions of the components of the mobile device 20 are given as follows. The ground plane 21 has a size of approximately 100 mm×70 mm, on which conductive housing 22 having a size of approximately 45 mm×30 mm×5 mm is mounted. The first conductive strip 23 has a size of approximately 45 mm×5 mm, and is spaced apart from the sidewall 221 by approximately 3.5 mm. The second conductive strip 24 has a size of approximately 8 mm×1.5 mm. The above-mentioned dimensions may vary in practical applications. Referring to FIG. 6, given a 50-ohm coaxial line, the measured results and simulated results on return loss are illustrated in curves 61 and 62, respectively. The simulation is conducted using a simulation software, High Frequency Structure Simulator ("HFSS"), by Ansoft Corporation. Specifically, for the UTMS (Universal Mobile Telecommunication System) band ranging from approximately 1920 to 2170 mega Hertz (MHz), FIG. 6 shows that the measured impedance matching is at least better than approximately 7.3 dB (2.5:1 VSWR (Voltage Standing Wave Ratio)), which is a relatively higher bandwidth definition for general mobile phone applications. A general mobile phone is usually designed in accordance with the bandwidth definition of at least 3:1 VSWR (6 dB return loss).

FIGS. 7A to 7D are diagrams illustrating radiation patterns of a monopole antenna in accordance with one embodiment of the present invention. Given the same monopole antenna and associated dimensions as in FIG. 6, referring to FIGS. 7A to 7D, a substantially omni-directional pattern may be achieved in the x-y plane when the monopole antenna operates at 2045 MHz, which is the center frequency of the UTMS band. Therefore, the monopole antenna according to the present invention satisfies the requirement for omni-directional properties.

Figure 8:
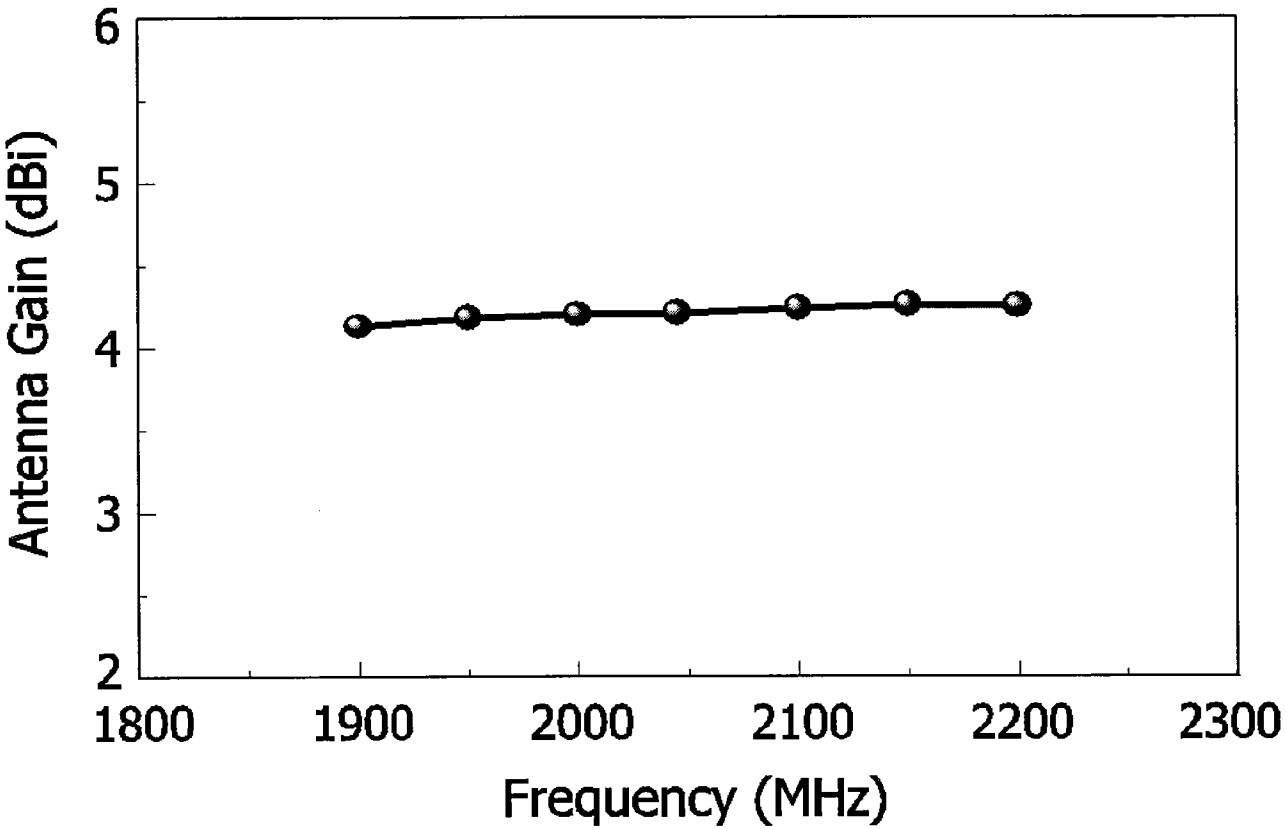
FIG. 8 is a plot illustrating the peak antenna gain of a monopole antenna in accordance with one embodiment of the present invention.

FIG. 8 is a plot illustrating the peak antenna gain of a monopole antenna in accordance with one embodiment of the present invention. Similarly, given the same monopole antenna and associated dimensions as in FIG. 6, referring to FIG. 8, the antenna gain is approximately 4.2 dB, which satisfies the requirement for practical mobile phone applications in the UTMS band.

It will be appreciated by those skilled in the art that changes could be made to the preferred embodiments described above without departing from the broad inventive concept thereof. It is understood, therefore, that this invention is not limited to the particular embodiments disclosed, but is intended to cover modifications within the spirit and scope of the present application as defined by the appended claims.

We claim:

1. A mobile device, comprising:

a ground plane;

a conductive housing disposed on the ground plane, the conductive housing including a sidewall generally perpendicular to the ground plane;

a first conductive strip spaced apart from the conductive housing, the first conductive strip including a surface extending generally in parallel with and opposed to the sidewall of the conductive housing;

a second conductive strip extending from an edge of the first conductive strip and electrically connecting the first conductive strip to the conductive housing;

a third conductive strip protruding from the first conductive strip, wherein the third conductive strip extends from the same edge of the first conductive strip as the second conductive strip; and a feeding contact disposed on the third conductive strip.

2. The mobile device of claim 1, wherein the second conductive strip includes a winding path extending from the first conductive strip to the conductive housing.

3. The mobile device of claim 1, further comprising a shorting contact disposed on a conductive surface of the conductive housing.

4. The mobile device of claim 1, wherein the second conductive strip extends from one edge of the first conductive strip, and the third conductive strip extends from another edge of the first conductive strip.

5. The mobile device of claim 1, wherein the sidewall of the conductive housing is generally flush with a side of the ground plane.

6. The mobile device of claim 1, wherein the first conductive strip includes a first portion extending generally in parallel with the sidewall and a second portion protruding from a side of the first portion.

7. The mobile device of claim 6, wherein the second conductive strip electrically connects the second portion of the first conductive strip to the sidewall.

8. The mobile device of claim 1, wherein the conductive housing comprises at least one of a radio frequency (RF) module, a RF circuit, or a battery.

9. A mobile device, comprising:

a ground plane;

a conductive housing disposed on the ground plane, the conductive housing including a plurality of sidewalls generally perpendicular to the ground plane, the plurality of sidewalls including an adjacent sidewall that is generally flush with a side of the ground plane, the other sidewalls of the plurality of sidewalls are not flush with the side of the ground plane;

a first conductive strip including a surface extending generally in parallel with and opposed to the adjacent sidewall of the conductive housing; and a second conductive strip electrically connecting the first conductive strip to the conductive housing; a third conductive strip protruding from the first conductive strip; wherein the second and the third conductive strip extend from a same edge of the first conductive strip.

10. The mobile device of claim 9, wherein the second conductive strip includes a winding path extending from the first conductive strip to the conductive surface of the conductive housing.

11. The mobile device of claim 9, wherein the first conductive strip includes a first portion extending generally in parallel with the sidewall and a second portion protruding from a side of the first portion.

12. The mobile device of claim 11, wherein the second conductive strip electrically connects the second portion of the first conductive strip to the sidewall.

13. The mobile device of claim 9, wherein the conductive housing comprises at least one of a radio frequency (RF) module, a RF circuit, or a battery.

* * * * *

UNITED STATES PATENT AND TRADEMARK OFFICE

CERTIFICATE OF CORRECTION

PATENT NO. : 8,044,860 B2
APPLICATION NO. : 11/279588
DATED : October 25, 2011
INVENTOR(S) : Tang et al.

It is certified that error appears in the above-identified patent and that said Letters Patent is hereby corrected as shown below:

Title page,
Item (73), Assignees: "Industrial Technology Research Institute, Chutung, Hsinchu (TW); National Sun Yatsen University, Chutung, Hsinchu (TW)" should read --Industrial Technology Research Institute, Chutung, Hsinchu (TW); National Sun Yat-Sen University, Kaohsiung City (TW)--.

Signed and Sealed this
Twelfth Day of February, 2013

Teresa Stanek Rea
*Acting Director of the United States Patent and Trademark Office*